United States Patent [19]

Halme et al.

[11] 3,994,774

[45] Nov. 30, 1976

[54] TWIN-WIRE PAPER MACHINE ADJUSTABLE TO SINGLE-WIRE MACHINE

[75] Inventors: Matti Halme, Helsinki; Kauko Heinanen, Jyvaskyla, both of Finland

[73] Assignee: Valmet Oy, Helsinki, Finland

[22] Filed: July 17, 1975

[21] Appl. No.: 596,590

[30] Foreign Application Priority Data

July 18, 1974 Finland ..... 2208/74

[52] U.S. Cl. ..... 162/273; 162/301; 162/350; 162/352

[51] Int. Cl.[2] ..... D21F 1/00; D21F 1/24

[58] Field of Search ..... 162/273, 274, 301, 350, 162/352, 203, 303

[56] References Cited

UNITED STATES PATENTS

| | | | |
|---|---|---|---|
| 2,881,675 | 4/1959 | Thomas | 162/301 X |
| 3,540,981 | 11/1970 | Finnila et al. | 162/301 |
| 3,623,945 | 11/1971 | Tommeraasen | 162/273 |
| 3,846,233 | 11/1974 | Kankaanpaa | 162/301 X |
| 3,894,486 | 7/1975 | Sparowitz et al. | 162/273 X |

*Primary Examiner*—S. Leon Bashore
*Assistant Examiner*—Richard V. Fisher
*Attorney, Agent, or Firm*—Steinberg and Blake

[57] ABSTRACT

A paper machine having upper and lower wires and wherein an adjusting structure cooperates with a portion of at least one of these wires to move this wire portion close enough to a cooperating portion of the other wire to achieve a twin-wire operation and to move the adjustable wire portion away from the cooperating wire portion to achieve at the latter a single-wire operation, so that at least in part the wires are adjustable one with respect to the other to provide for the option of operating the machine, at least in part, as a single-wire machine or as a twin-wire machine.

15 Claims, 6 Drawing Figures

TWIN-WIRE PAPER MACHINE ADJUSTABLE TO SINGLE-WIRE MACHINE

BACKGROUND OF THE INVENTION

The present invention relates to paper machines having a pair of wires which cooperate to achieve a twin-wire operation.

Thus, the present invention relates to a paper machine having a twin-wire construction according to which the stock is supplied from a headbox with the wires including a lower wire which forms a closed loop and an upper wire which also forms a closed loop. The lower wire has an initial web-forming portion guided by suitable rolls and coacting with a suitable dewatering structure so that the stock is received from the headbox on the initial web-forming portion of the lower wire, this initial web-forming portion normally extending along a straight planar path. A deflecting means of the invention cooperates with the initial web-forming portion of the lower wire to deflect the wire downwardly beyond the initial web-forming portion thereof along a downwardly inclined plane and the upper wire is guided so as to cooperate permanently with the portion of the lower wire which extends beyond the deflecting means to achieve a permanent twin-wire operation subsequent to the deflecting means. A suitable dewatering structure cooperates with the downwardly inclined portions of the wires which provide the permanent twin-wire operation.

As is well known, the paper machine which is most common in use is the fourdrinier machine. The formation of a continuous paper web on such a machine usually takes place on a substantially horizontal run of wire inasmuch as the paper fibers are supplied to the moving wire fabric in the form of a dilute suspension containing a quantity of water which is approximately 100–400 times the amount of fibers. The water which is present in the fiber suspension is filtered off through the wire in one direction, namely, downwardly in part by the action of gravity and in part by suction produced by structure which supports the wire. After sufficient water has been removed the fibers form a coherent web which then is separated from the wire to be conducted to the press section of the paper machine and then beyond the press section to the drying section.

The feed of the fiber suspension onto the wire of the fourdrinier machine takes place by way of a headbox having at its lower part adjacent to the wire a narrow slit or slice the length of which corresponds to and extends across the width of the wire. From the slice the fiber suspension discharges onto the wire in the form of a relatively coherent jet.

The slice of the headbox is defined between upper and lower lips. The upper lip may be adjusted so as to have different positions with respect to the lower lip, and in this way it is possible to adjust the angle at which the stock jet impinges the wire. The velocity of the stock jet relative to the linear speed of travel of the wire is also adjustable. Such adjustments exert in part an influence on the properties of the paper that is manufactured.

In recent years twin-wire formers have come into use, these machines differing from the fourdrinier in that the formation of the paper web takes place between a pair of wires with dewatering accordingly taking place simultaneously in a pair of opposed directions through both of the wires. In this way it is possible to accelerate the dewatering considerably. As a result of this increased efficiency in the dewatering action, a twin-wire section can be made much shorter and in many ways is more economical than a conventional fourdrinier.

However, twin-wire formers have a drawback in that generally the stock from the headbox is supplied into a throat which is formed between the wires, so that immediately upon receiving the stock in this throat there starts an extremely intense, violent dewatering of the stock web which is being formed, the dewatering action taking place in opposed directions through both wires. Together with the violent extraction of water resulting from these operations, fine fibers also tend to escape from the stock in an abundant quantity together with filler which is usually included in the suspension. Such fillers are indispensable when it is desired to achieve certain types of papers. In the paper web which is undergoing the process of being formed and which still has a considerably large water content and which still has not achieved a sufficient firmness, relatively long fibers may also move along with the violent dewatering flow and be transposed from the central or interior part of the web to the surface layers or regions thereof. As a result the central structure of the web weakens with the result that such paper has a low splitting strength.

In order to manufacture certain types of papers which are required for printing purposes, for example, the paper for such purposes is required to have, for example, a high degree of opacity, and the principles of operation of the twin-wire machine are not appropriate for the manufacture of such paper. However, there are papers which utilize primarily pulp stock having long fibers and no fillers, and for papers of this type it is possible to use in a highly successful manner the efficient dewatering of the twin-wire formers while still maintaining a high machine speed.

It has already been proposed to provide a twin-wire machine designed primarily for the manufacture of fine paper. This proposed construction operates in part with one wire and in part with two wires, so that it is possible in this way to combine the advantages of the conventional fourdrinier with the advantages of a twin-wire former, while at the same time a number of the detriments of both types of machines can be avoided. At the single-wire part of the machine the web formation takes place in the conventional fourdriener manner with a gradual non-violent removal of water. After the stock web has reached a given degree of felting which is appropriate with respect to the mutual bonding of the fibers, the wet end transforms into a twin-wire construction where dewatering is highly efficient in accordance with the general principles of operation of twin-wire formers, but because of this particular construction the quality of the paper does not suffer.

It is to be noted that paper which has been produced by way of a paper machine invariably is at least to some extent non-homogeneous, particularly with respect to the structure which can be observed with the naked eye or, for example, with respect to its strength characteristics. The fibers have the undesirable tendency of aggregating to form bundles or flocs, which become apparent as dark spots in the finished paper when viewed against the light. As a result of the elongated configuration of the fibers they tend, when the stock suspension emerges from the slice of the headbox, to arrange themselves in the direction of flow and also to remain in the finished paper oriented primarily parallel to the direction of travel of the paper web in the paper machine. Paper which has a relatively strong orientation of fibers will have a much higher tensile strength in the direction of machine travel than in a transverse direction across the machine. Such a property is of advantage in the case where it is desired intentionally to have a high strength in the paper in the direction of travel in the machine, such paper being suitable for spinning paper or for paper from which paper string is made. Most often, however, it is desired that the ratio between the strength of the paper in the direction of machine travel and transversely with respect to the direction of machine travel should be as low as possible, and this highly desirable result can only be achieved by preventing a pronounced orientation of the fibers. This latter type of paper is important in the manufacture of printing paper which is required to have a high dimensional stability.

It is possible for papers to be non-homogeneous in two different ways. The floc content or cloudiness, a property included under the concept of "paper formation", becomes immediately visible to the naked eye. Anisotropy, which is the difference between the properties of the paper in the direction of the machine travel and transversely to this direction, is a characteristic which may become externally observable under certain circumstances (such as, for example, where curling of the paper in a given direction takes place when the paper is wet), but it is for the most part only demonstrable by way of laboratory equipment (such as equipment which will indicate the strength properties of the paper). It is possible to influence both the formation and anisotropy by way of the interaction between the headbox and wire section. The most important process variables to which attention must be given in this connection are the following:

1. the speed of discharge of the stock jet relative to the wire speed,
2. the angle at which the stock jet impinges on the wire, and
3. the rate at which the water escapes from the suspension which has been conducted onto the wire.

The above factors affect not only fiber orientation but also the manner in which the web forms. It is in addition to be noted that if the formation of the paper is to be improved it is necessary to operate under conditions which lead to an increased fiber orientation. Thus, the paper-maker is compelled to select for the paper machine those particular operating conditions which will provide a compromise between factors which will reduce orientation and those which will improve formation. The pronounced orientation of the fibers can usually be maintained at its minimum when the wire speed equals the velocity of the stock jet discharging onto the wire. On the other hand, the best possible web formation requires that the wire speed should be somewhat greater than the speed of velocity of the stock jet.

In order to prevent undesirable fiber orientation, it is possible, in addition to optimizing the velocity ratio of the wire and jet, to take suitable action by controlling the dewatering of the stock suspension. The rate of dewatering can be influenced by placing beneath the wire at the point where the stock jet meets the wire a suitable forming board. The forming board may be covered either with a solid or perforated covering or may be provided with slits. The design is chosen according to what is known from experience to produce the best results with respect to control of the rate of dewatering.

It is also possible to influence dewatering by adjusting the angle at which the stock jet meets the wire. The larger this angle, the stronger the tendency of the water to escape through the wire. This angle is adjusted in the simplest manner by way of adjusting the position of the lips of the headbox slice with respect to each other.

In all of the known twin-wire machines the feeding of the stock jet takes place by directing the jet directly into the throat where the wires meet. The direction of the jet is symmetrical with respect to the converging paths of travel of the wires as they travel to the throat where they meet to provide the twin-wire operation. As a result from the throat on the dewatering starts at a fast rate in both directions simultaneously through both wires.

While this type of feeding of the stock is without a doubt highly efficient with respect to dewatering, it introduces certain drawbacks as compared with the operation of the older fourdrinier wire section. When the stock jet is directed straight into the throat symmetrically between the wires, the arrangement and orientation of the fibers in the web will be exactly the same as the arrangement and orientation of the fibers in the jet. The mutual positions and arrangements of the fibers cannot any longer be influenced as is possible in the case of a fourdrinier wire section over a distance of about 50–100 cm, measured from the headbox slice forwardly in the direction which the wire travels.

Of course, it is to be noted that those headbox constructions which are employed at the present time with twin-wire formers feed the stock suspension in between the wires in such a state that there is no fiber orientation in the jet and therefore there is no observable strong orientation in the web that is formed. However, as has been pointed out above, there are certain types of paper which in view of their intended use would require most advantageously to have a fiber orientation in the direction of machine travel. In principle such orientation can be achieved by providing for the jet of stock which discharges a velocity from the slice which is less than the speed of the forming wire, so that the orientation will result from the combing effect exerted by the wire. In conventional twin-wire formers, however, no such combing effect can be developed because the position of the fibers in the stock jet is fixed or frozen between the wires so that no change can be made from the positions which the fibers have in the stock jet.

SUMMARY OF THE INVENTION

It is accordingly a primary object of the present invention to provide a twin-wire machine which is capable of being adjusted so that it becomes possible to provide for manufacture on the same machine different types of paper as required.

Thus, it is a primary object of the present invention to provide an adjustable twin-wire machine which can be adjusted in such a way that at least part of the machine can be selectively operated either as a single-wire machine or as a twin-wire machine.

Thus, it is an object of the invention to provide a twin-wire machine which is suitable for producing any and all types of paper. In other words it is an object to achieve a universal machine which can be easily adjusted depending upon the requirements of the particular type of paper which is desired so that a particular type of paper can be produced with the quality of the paper being controlled and while at the same time maintaining the highest possible dewatering capacity.

In particular it is an object of the present invention to provide a twin-wire machine where while part of the machine may provide a permanent twin-wire operation another part thereof can be adjusted to provide either a single-wire operation or a twin-wire operation so that it becomes possible, consistently with different types of operating conditions in the paper-making process, to provide different types of paper stock with different paper characteristics. It is therefore within the objects of the invention to provide an improvement in the formation of webs by twin-wire formers, so that the presently existing means and possibilities for control of the properties of the paper such as formation and orientation are preserved, as mentioned above, while providing for the paper maker the possibility of bringing out adjustments to which he is accustomed in practice in connection with a fourdrinier machine.

In order to achieve the above objectives it is possible with the invention that part of the wire guiding rolls and/or dewatering means cooperate with suitable supporting and adjusting members by means of which the path of the upper wire and/or the lower wire can be changed so that the paths of the upper and lower wires coincide on a part of the lower wire which is supported by a dewatering means preceding a subsequent part of the lower wire loop. It is thus to be understood that the twin-wire section of the invention has upper and lower wires adjustable with respect to each other and having suitable wire-guiding and dewatering means the positions of which can be changed so as to bring about a partial twin-wire construction which can then be converted into a complete twin-wire construction, where the formation of the web and the dewatering thereof take place substantially completely between the upper and lower wires.

It is to be recognized that in a complete twin-wire former the feeding of the stock from the headbox takes place most appropriately directly into the throat at the entrance end of the web-forming portion of the wires. With a partial twin-wire former, in contrast, there will be a comparatively long single-wire operation where the web is initially formed and which may in fact have a length exceeding that of the subsequent web-forming portion where a twin-wire operation is provided.

Thus, in more simple terms, the machine of the invention has upper and lower wires respectively having portions at least one of which is adjustable with respect to the other so as to achieve between these portions either a twin-wire operation when one portion is adjusted so as to be displaced close enough to the other portion to achieve a twin-wire operation, while also being capable of achieving a single-wire operation when one of the wire portions is displaced away from the other to an extent sufficient to provide for a single-wire operation.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
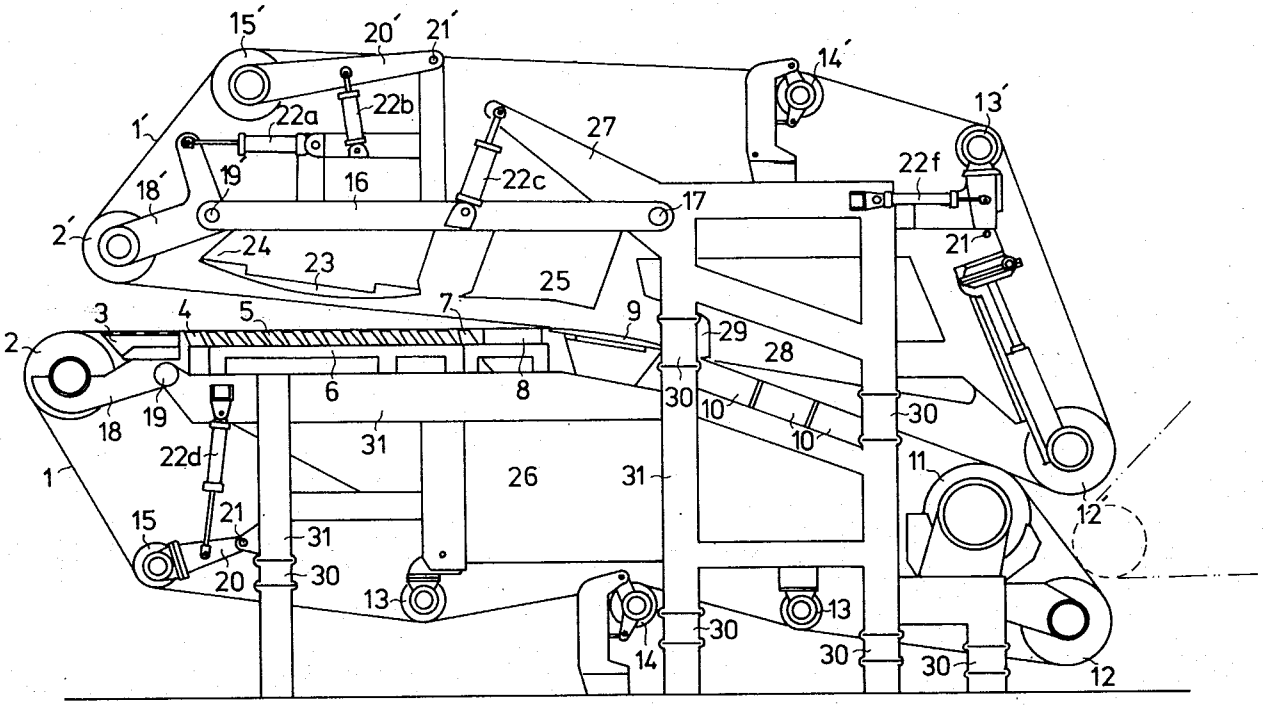
FIG. 1 is a schematic side elevation of a machine according to the invention, the structure being shown without a headbox and being illustrated in a condition where only partial twin-wire operation is provided.
Figure 5:
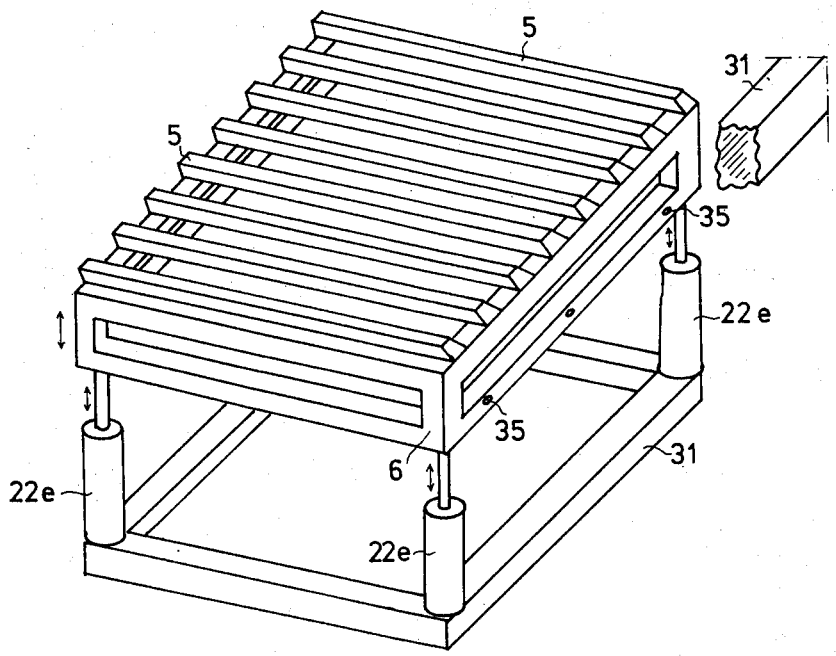
FIG. 5 is a schematic perspective illustration of a movable dewatering means used in the embodiment of FIGS. 1 and 2 with FIG. 5 also illustrating the moving means which moves the movable dewatering means.

Referring first to FIG. 1 it will be seen that there is schematically illustrated therein a lower wire 1 which is guided at its upper left end, as viewed in FIG. 1, around a breast roll 2 just beyond which is located a breast board 3. The stock jet which discharges from the unillustrated headbox impinges on the wire 1 at the breast board 3, and of course this is the region where web-formation starts. A dewatering means cooperates with the wire 1 just beyond the component 3 in order to bring about a dewatering action in a manner similar to a conventional fourdrinier, and in the illustrated example this dewatering means includes a pair of components 4 and 7 which may, for example, take the form of suitable foils. Between these foils 4 and 7 is located a further unit 5 of the dewatering means, this part 5 of the dewatering means including a plurality of foils extending transversely across the wire 1 and mounted on a suitable frame 6. This frame 6 together with the dewatering structure 5 carried thereby forms a movable dewatering means capable of being moved by a moving means shown in FIG. 5 and described below. Thus, the dewatering means 4, 5, 7 removes water from the fiber web through the wire 1 in a downward direction, and the removed water is collected in a saveall 26. Within the loop which is formed by the wire 1 there is also a stationary wet suction box 8 and a deflecting means 9 in the form of a shoe having an upper convex arcuate surface engaging the wire 1, the shoe 9 preferably having a closed cover. At the leading edge of the deflecting means 9, which is to say the left edge thereof as viewed in FIG. 1, the upper wire 1′ engages the lower wire 1 so as to engage the fiber web which has formed on the portion of the wire 1 extending in the horizontal plane apparent from FIG. 1 from the breast roll 2 to the deflecting means 9. Thus, as the wires 1 and 1′ travel together along and beyond the deflecting means 9, these wires cooperate to provide a permanent twin-wire operation and water will now escape through the upper wire 1′ upwardly so as to be collected with the aid of a doctor blade 29 in a saveall 28. The part of the lower wire 1 which extends beyond the deflecting means 9 engages conventional planar suction boxes 10 and reaches the suction roll 11 which together with the suction boxes 10 serve to remove water through the lower wire. While it is possible to separate the upper wire 1′ from the lower wire 1 at the location of the last suction box 10, in the illustrated example the upper wire 1′ becomes separated from the lower wire 1 at the suction roll 11. The web which has formed continues to travel with the wire 1 beyond the suction roll 11 toward roll 12 shown at the lower right of FIG. 1, and between these rolls 11 and 12 the web is picked up by a pick-up roll as is well known and as is schematically depicted with the phantom line illustration at the lower right portion of FIG. 1.

Thus, it will be seen that in the example of FIG. 1 the rolls 11 and 12′ form a pair of guide rolls situated distant from the breast rolls 2 and 2′, the latter breast roll cooperating with the upper wire 1′, with these guide rolls 11 and 12′ providing for the pair of wires a permanent twin-wire operation at the region where web-formation ends.

The upper wire 1′ returns around the guide or traction roll 12′, and then along the leading roll 13′, the guiding roll 14′, and the tension roll 15′ back to the breast roll 2′ of the upper wire 1′. In a similar manner the lower wire returns from the traction roll 12 to one of the pair of illustrated leading rolls 13, then around a guiding roll 14 to the other of the rolls 13 and from the latter around the tension roll 15 back to the breast roll 2.

Figure 2:
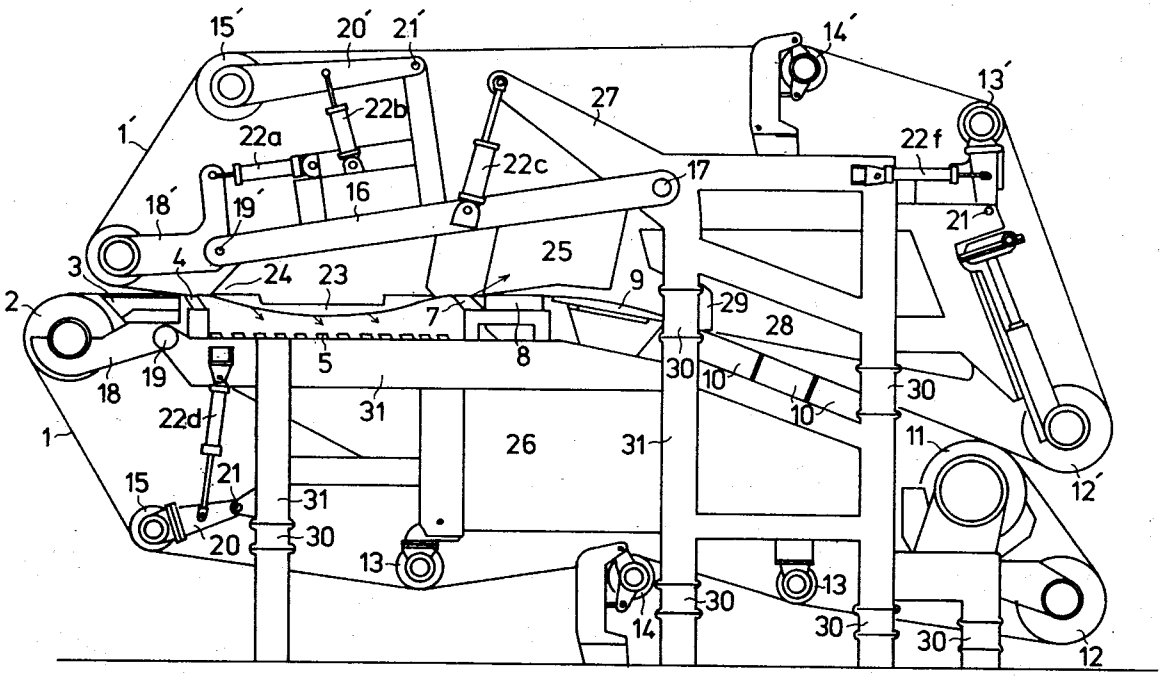
FIG. 2 illustrates the structure of FIG. 1 in a condition where full twin-wire operation is provided.

It will be seen from FIG. 2 that the portion of the upper wire extending from the breast roll 2′ to the deflecting means 9 has been displaced close enough to the portion of the lower wire extending from the breast roll 2 up to the deflecting means 9 to cooperate therewith to achieve a twin-wire operation from the breast board 3 all the way up to the deflecting means 9 so that with such an adjustment of the machine a full twin-wire operation is achieved. This conversion from the partial twin-wire operation of FIG. 1 to the full twin-wire operation of FIG. 2 is brought about by an adjusting means which cooperates with the upper wire 1′ so as to displace the latter in the manner apparent from a comparison of FIGS. 1 and 2 to a position capable of cooperating with the lower wire to achieve the twin-wire operation illustrated in FIG. 2. The adjusting means also cooperates with a dewatering means to provide for the full twin-wire operation of FIG. 2 a different type of dewatering action from that of FIG. 1.

Just before the wires have been placed in the condition shown in FIG. 2, the movable dewatering means 5 is lowered from the position of FIG. 1 to the position of FIG. 2. This is brought about by way of a moving means shown in FIG. 5. Thus, the frame 31 of the machine carries fluid-pressure cylinders 22*e* which cooperate with the movable frame structure 6 which carries the dewatering foils 5 so as to lower the unit 5, 6, so that when the machine has the position of FIG. 2 the lower wire 1 no longer engages the foils of the unit 5. Of course when the machine is returned to the position shown in FIG. 1 the cylinders 22*e* are operated to raise the frame 6 and the dewatering means 5 carried thereby to the upper position of FIG. 1. In order to fix the frame 6 in this upper position the frame 6 is provided with openings 35, and a part of the frame 31 is provided with pins which are inserted into the openings 35, when the dewatering means 5 has the elevation shown in FIG. 1 engaging the lower surface of the upper run of the wire 1, so that the dewatering means 5 is maintained in the position of FIG. 1 not by pressure of fluid in the cylinders 22*e* but rather by way of a connection to the supporting frame structure 31 through pins carried by the latter and displaced into the openings 35 of the movable frame 6. These pins are of course removed just prior to lowering of the dewatering means 5 to the position of FIG. 2, and in this latter position the frame 6 can remain unsecured and can rest directly, for example, on the top ends of the cylinders 22*e*.

As is apparent from FIGS. 1 and 2 the tension roll 15 is carried by a lever 20 which through a fluid-pressure means 22*d* is connected to the stationary frame 31. Upon lowering of the dewatering means 5 this fluid-pressure means 22*d* is actuated so as to raise the lever 20 while turning the latter about the pivot 21 carried by the frame 31, so that the tension in the wire 1 is slackened.

In order to place the upper wire 1′ into contact with the lower wire 1 at the dewatering means 4 where the web formation starts, a fluid pressure means 22*c* is actuated. This fluid-pressure means 22*c* is pivotally carried by the extension 27 of the frame structure 31 which also serves to pivotally support an elongated beam 16 by way of a pivot 17. The fluid-pressure means 22*c* is pivotally connected also to the beam 16, so that by operation of the fluid-pressure means 22*c* it is possible to swing the beam 16 downwardly from the position of FIG. 1 to the position of FIG. 2.

The beam 16 also carries a member 23 provided with a lower convex surface which serves to curve the upper and lower wires where they engage each other over the lowered dewatering means 5 first downwardly from and then back up to the plane occupied by the initial portion of the wire 1 when it has the position shown in FIG. 1, this portion of the wire 1 extending from the breast roll 2 up to the deflecting means 9. Of course, the dimension of the member 23 transversely with respect to the plane of FIGS. 1 and 2 is the same as the width of the wires, so that the member 23 extends across the entire width of the wire 1′. The beam 16 is lowered around the pivot 17 to such an extent that the leading and trailing edges of the member 23 are situated in the same plane as the pair of dewatering means 4 and 7 which are respectively located just before and just after these leading and trailing edges, respectively.

The beam 16 itself serves to pivotally support by way of a pivot 19′ a lever 18′ which carries the breast roll 2′ of the upper wire 1′. The lever 18′ is in the form of a bell crank one arm of which is connected by way of the fluid-pressure means 22*a* to a supporting structure fixed to and extending upwardly from the beam 16 so as to turn with the latter. Thus the fluid-pressure means 22*a* is actuated to turn the lever 18′ in a clockwise direction, as viewed in FIGS. 1 and 2, with respect to the beam 16 from the position of FIG. 1 to the position of FIG. 2 while the beam 16 itself turns in a counterclockwise direction, so that in this way it is possible to place the upper wire 1′ in the position shown in FIG. 2. It will be noted that the adjustment is such that the part of the wire 1′ which extends around the breast roll 2′ is situated above and out of engagement with the part of the wire 1 which engages the breast board 3. As these adjustments are carried out the lower wire is again placed under proper tension and the upper wire tends to slacken. However, through suitable automatic sensing structures the rolls 13′ and 15′ are adjusted so as to bring about in the wire 1′ also a proper tension when the parts have been adjusted to assume the position shown in FIG. 2. The roll 13′ has its position regulated by way of a fluid pressure means 22*f* which at one end is carried by the frame 31 and which at its opposite end is connected to a lever pivotally mounted on the frame 31 by way of a pivot 21 shown at the upper right portion of FIGS. 1 and 2. The upper tensioning roll 15' is carried by a lever 20' which at 21' is pivotally carried by a supporting structure fixed to and extending upwardly from the beam 16, and part of the supporting structure carried by the beam 16 is pivotally connected with a fluid-pressure means **22*b* which in turn is connected to the lever 20' so as to turn the latter and thus regulate the position of the tensioning roll 15'**.

When the machine has the position shown in FIG. 2 where a full twin-wire operation is provided, the stock jet which issues from the unillustrated headbox arrives at the throat defined between the wires 1 and 1' just over the breast board 3. At the trailing edge of the dewatering means 4 the wires 1 and 1' both curve downwardly in accordance with the curvature of the shoe 23. At this region where the wires curve downwardly there will be a dewatering action upwardly through the upper wire 1' as a result of inertia, and the water which is flung upwardly through the wire 1' at this location is received in a saveall 24 situated just over the shoe 23. Beneath the shoe 23 the water escapes downwardly into the saveall 26. The dewatering action is achieved by way of gravity, centrifugal force, and the force resulting from the compression of the web between the tensioned wires. The frame 6 is lowered to such an extent that the foils 5 do not touch the wires when they have the position of FIG. 2 and do not in any way impede the escape of water.

At the trailing edge of the member 23 and also at the leading edge of the dewatering means 7 the path of the wires changes from a curved path again to a straight path, and at this point there is also a change in the inertia forces to bring about a removal of water through the upper wire 1' into the saveall 25. Beyond the dewatering means 7 the pair of wires move along the stationary wet suction box 8 and then are deflected downwardly by the deflecting means 9 along the downwardly inclined plane as illustrated, so that from the region of the deflecting means 9 up to the region where the web formation ends the operation of the machine in FIG. 2 is the same as that in FIG. 1.

It is to be noted that the trailing edge of the dewatering means 4 and the leading edge of the dewatering means 7 are suitably rounded in order to prevent excessive friction between the wire 1 and these elements at the locations where the curving of the wires takes place.

It is to be noted that when the parts are returned to the position shown in FIG. 1, the fluid-pressure means **22*a* acts on the lever 18' to lower the breast roll 2' with respect to the beam 16 to such an elevation that the upper wire 1' is below and out of engagement with the shoe 23 so that unnecessary friction with the latter is avoided when the parts have the position of FIG. 1.**

From the savealls 24 and 25 flexible connections are provided to the drive side of the machine. Such connections permit because of their flexibility the required movement of the means 16 together with the savealls 24 and 25 between the positions of FIGS. 1 and 2.

It is to be noted that the frame structure 31 both at its lower portion which extends through the wire 1 and at its upper portion which has the extension 27 and which extends through the wire 1' is cantilever-mounted in a direction perpendicular to the plane of FIGS. 1 and 2. In other words this frame structure is supported at one end by a wall or other supporting structure parallel to the plane of FIGS. 1 and 2 and situated at one side of the wires 1 and 1'. Separate parts of the cantilevered frame structure 31 are maintained at proper elevations with respect to each other by way of the spacers 30 as schematically indicated. These spacer inserts 30 may be removed to enable the wires 1 and 1' to be removed and replaced, these wires being pushed into the proper position by way of suitable wire carriages. When the wires 1 and 1' have been placed in the proper position the inserts 30 are replaced so that parts of the cantilevered frame structure which extend beyond the wires will be supported from the floor as illustrated. If desired the upper portion of the structure may be arranged in such a way that it can be lifted in its entirety.

Figure 3:
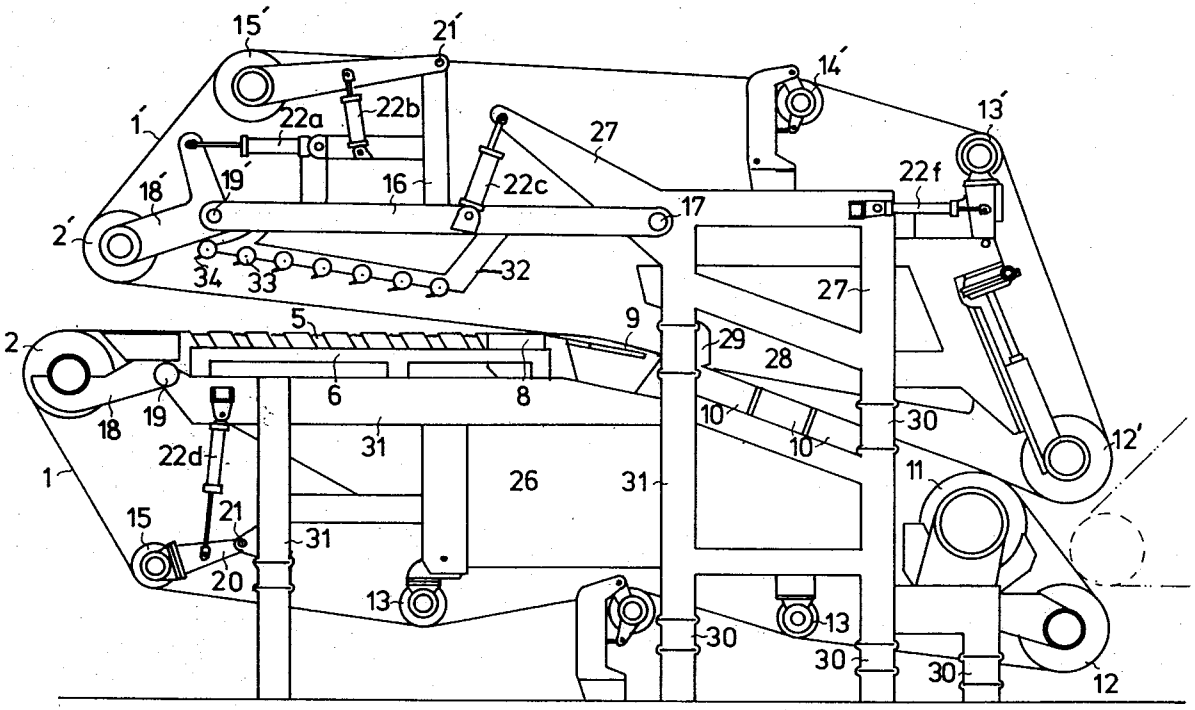
FIG. 3 is a schematic side elevation of a machine according to the invention, also illustrated without a headbox, but having a construction different from that of FIGS. 1 and 2, the machine of FIG. 3 being shown in a condition where partial twin-wire operation is provided.
Figure 4:
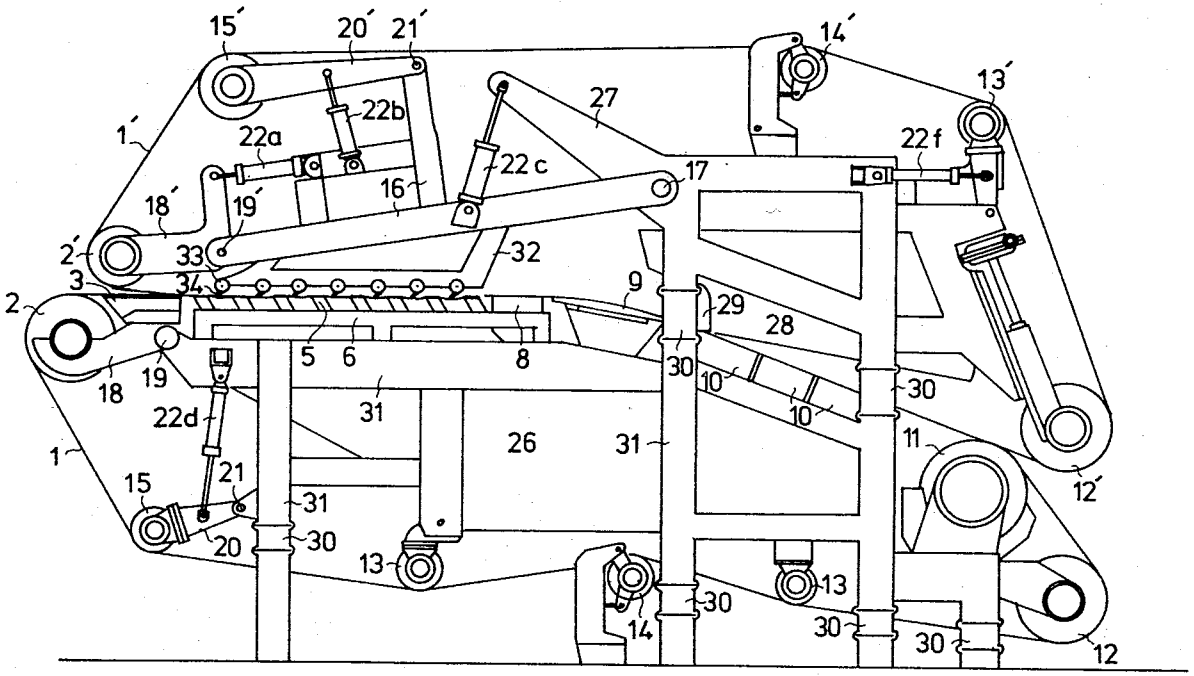
FIG. 4 is a side elevation showing the structure of FIG. 3 in the condition where full twin-wire operation is produced.

In the embodiment of the invention which is illustrated in FIGS. 3 and 4, the machine has, except for differences pointed out below, the same structure as described above in connection with FIGS. 1 and 2, and the same parts have been designated by the same reference characters. The manner in which the machine operates to provide a full twin-wire operation is shown in FIG. 4 whereas the partial twin-wire operation is illustrated in FIG. 3.

With respect to the lower wire 1, in the embodiment of FIGS. 3 and 4 the dewatering means 5 and supporting frame structure 6 remain stationary at the elevation illustrated so that in this embodiment it is not necessary to provide a movable dewatering means and a moving means to move the latter. Thus the top surfaces of the foils of the dewatering means 5 remain continuously at the elevation of the breast board 3 and the wet suction box 8.

Also, with the embodiment of FIGS. 3 and 4, there is no member such as the member 23 with a lower curved surface to engage and curve the wires in the manner shown in FIG. 2. Instead with the embodiment of FIGS. 3 and 4 there are a plurality of tubular suction dewatering members 33 or the equivalent thereof, these suction dewatering tubular members 33 being carried also by the beam 16. For this purpose a frame 32 is provided to connect the dewatering units 33 to the beam 16 for swinging movement with the latter about the pivot 17 in the manner described above.

Figure 6:
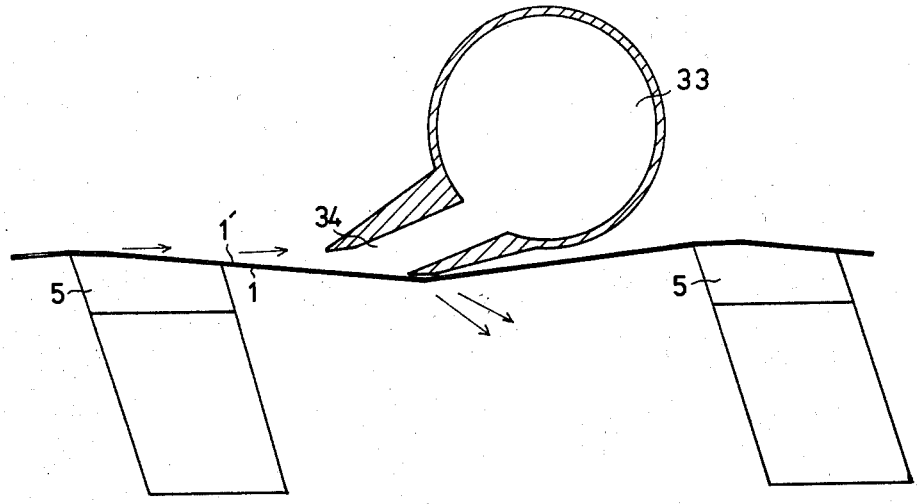
FIG. 6 is a schematic partly sectional elevation showing, on an enlarged scale as compared with FIG. 4, the manner in which dewatering elements of FIG. 4 cooperate with the wires when the full twin-wire operation of FIG. 4 is provided.

Each tubular suction dewatering member 33 is provided with an elongated suction inlet 34, as is most clearly apparent from FIG. 6. When the upper portion of the wire 1' is lowered from the position of FIG. 3 to the position of FIG. 4 the downward movement of the beam 16 also serves to bring the dewatering elements 33 together with their suction inlets 34 to the position shown in FIG. 4 and illustrated in detail in FIG. 6. Thus, the inlets 34 of the several tubular suction means 33 become situated in the spaces between the foils of the dewatering means 5. Therefore, when the machine has the position of FIG. 4 the dewatering means 5 still operates in the normal manner to bring about dewatering through the lower wire 1. However, the several suction means 33 by way of their inlets 34 curve portions of the wires 1 and 1' downwardly into the successive spaces between the successive foils of the dewatering means 5, and in this way the pair of wires 1 and 1' are guided along a wavy path and an effective escape of water upwardly through the upper wire 1' is produced, this action being further enhanced by the pressure in the tubes 33, this latter pressure of course being less than atmospheric pressure. Thus, the mouth of each tube 33 collects the water and it is carried out through the tubes 33 and through flexible connectors respectively connected with the tubes 33 and situated at the rear side of the machine.

The dewatering action from the suction box 8 to the region of the end of the web formation is the same as described above in connection with FIGS. 1 and 2.

When a single-wire operation is achieved by returning the parts from the position of FIG. 4 to the position of FIG. 3, the beam 16 is swung in a clockwise direction about the pivot 17 by way of the fluid-pressure means 22c from the position of FIG. 4 to the position of FIG. 3. At the same time the lever 18' is turned about the pivot 19' by way of the fluid-pressure means 22*a*, so that the breast roll 2' turns downwardly with respect to the beam 16. This action lowers the wire 1' so that it no longer engages the inlets 34 of the tubular suction means 33 and thus avoids unnecessary friction when the parts have the position of FIG. 3. The beam 16 is turned upwardly to such an extent that the wires 1 and 1' only become situated close enough to each other to achieve the twin-wire operation at the deflecting means 9.

It will be noted that with the embodiment of FIGS. 3 and 4 no adjustments are required with respect to the lower wire 1. Of course the tension roll 15 is automatically adjusted so that the wire 1 at all times is provided with the desired tension. In other words when converting from the position of FIG. 4 to the position of FIG. 3 the position of tension roll 15 will be adjusted so as to raise, if necessary, any portions of the wire 1 which will extend into the spaces between the foils of the dewatering means 5. In a similar manner the roll 15' provides the required tension in the upper wire 1'. Thus when the machine has the position of FIG. 3, the part of the lower wire 1 where web formation initially takes place is planar to provide a fourdrinier operation at this part.

In both of the above embodiments of the invention the conversion from at least a partial twin-wire operation to a full twin-wire operation and the reverse can be arranged so as to take place in a completely mechanical manner by way of suitable cylinders since there are no elements which must be removed or added to change between the different types of operation. The displacement of the supporting arms and rolls can be arranged so as to operate either hydraulically or pneumatically. When a conversion command is transmitted to the system, the hydraulic or pneumatic structures will automatically respond until the required change has been carried out. It is to be understood, of course, that the rolls and frames need not in operation rest only on the cylinders 22*a* – 22*e*. Instead during operation these structures may be secured so that they are not supported by fluid under pressure. Such securing and a corresponding release of the securement may also be carried out automatically by way of suitable apparatus known in itself and therefore not illustrated.

What is claimed is:

1. In a paper machine capable of operating at least in part as a single-wire machine or a twin-wire machine, upper and lower wires and adjusting means operatively connected with at least one of said wires for displacing a portion thereof to a location sufficiently close to a portion of the other of said wires to bring about a twin-wire operation between said portions of said wires and for displacing said portion of said one wire away from said portion of said other wire to a location spaced sufficiently therefrom to provide a single-wire operation at that one of said portions which forms part of said lower wire, and a dewatering means cooperating with said wires, said adjusting means being operatively connected with said dewatering means for providing dewatering action simultaneously in opposite directions outwardly through both of said wire portions when said wire portions carry out said twin-wire operation and for providing a dewatering action only downwardly through said portion of said lower wire when said lower wire portion has said single-wire operation.

2. The combination of claim 1 and wherein said adjusting means is operatively connected with said upper wire for displacing said portion thereof toward and away from said portion of said lower wire to bring about either said twin-wire operation or said single-wire operation.

3. The combination of claim 1 and wherein a means cooperates with at least one of said portions of one of said wires for directing said portions of said wires during twin-wire operation at least in part along a non-planar path.

4. The combination of claim 1 and wherein a pair of breast rolls respectively cooperate with said wires respectively adjacent ends thereof where web-formation starts and wherein a pair of guide rolls which are distant from said breast rolls respectively cooperate with said wires at a region where web-formation ends for maintaining said wires at least at the latter region sufficiently close to each otehr to provide for permanent twin-wire operation at said region where web-formation ends.

5. The combination of claim 4 and wherein said adjusting means cooperates at least with said breast roll of said upper wire for displacing the latter breast roll toward and away from said lower wire, and deflecting means engaging at least one of said wires between said breast rolls and guide rolls for maintaining parts of said wires which travel beyond said deflecting means toward said guide rolls close enough to each other to provide for said permanent twin-wire operation, said portions of said wires respectively extending between said deflecting means and breast rolls, and said deflecting means cooperating with said portion of said upper wire for deflecting the latter portion of said upper wire toward said portion of said lower wire when said breast roll of said upper wire is displaced toward said lower wire to achieve twin-wire operation between said portions of said wires and for deflecting said portion of said upper wire away from said portion of said lower wire when said adjusting means displaces said breast roll of said upper wire away from said lower wire to achieve said single-wire operation at said portion of said lower wire.

6. The combination of claim 5 and wherein said guide rolls are situated at an elevation lower than said breast rolls while said deflecting means engages said lower wire for deflecting both wires downwardly from said portion of said lower wire along an inclined plane where said wires permanently provide the twin-wire operation.

7. The combination of claim 6 and wherein said deflecting means is a shoe of arcuate configuration.

8. The combination of claim 5 and wherein a member having a lower convex surface is operatively connected with said adjusting means for curving said portion of said upper wire together with said portion of said lower wire downwardly below a plane occupied by said portion of said lower wire during said single-wire operation when said portion of said upper wire has been displaced by said adjusting means and breast roll of said upper wire close enough to said portion of said lower wire to achieve said twin-wire operation between said portions of said wires.

9. The combination of claim 8 and wherein said dewatering means includes a movable dewatering means cooperating with said portion of said lower wire during said single-wire operation thereof, and said adjusting means including a moving means operatively connected with said movable dewatering means for moving the latter downwardly away from said portion of said lower wire to provide clearance for curving of said lower wire by said member having said convex surface at a time when said wire portions provide said twin-wire operation.

10. The combination of claim 5 and wherein said dewatering means includes a stationary dewatering means engaging said portion of said lower wire and including a plurality of mutually spaced foils extending across said portion of said lower wire, and said dewatering means further including a suction dewatering means cooperating with said portion of said upper wire for providing for dewatering action therethrough, said suction dewatering means being operatively connected with said adjusting means to be displaced thereby to an operating position achieving a suction dewatering action only when said portions of said wires provide said twin-wire operation.

11. The combination of claim 10 and wherein said adjusting means is operatively connected with said suction dewatering means for displacing the latter to a position out of engagement with said portion of said upper wire when said adjusting means displaces said portion of said upper wire away from said portion of said lower wire to achieve a single-wire operation at said portion of said lower wire.

12. The combination of claim 10 and wherein said suction dewatering means includes a plurality of suction tubes and a plurality of elongated inlets respectively cooperating with said suction tubes and situated by said adjusting means respectively in spaces between said foils during the twin-wire operation of said portions of said wires, whereby said suction inlets deflect said wires into the spaces between said foils to provide a wavy path of travel for said portions of said wires at the location where said lower wire travels past said foils.

13. The combination of claim 5 and wherein said adjusting means includes an elongated beam situated over said portion of said upper wire, a lever pivotally connected to said beam and carrying said breast roll of said upper wire, and a means connected to said lever for turning the latter with respect to said beam to contribute at least in part toward movement of said breast roll of said upper wire toward and away from said lower wire.

14. The combination of claim 13 and wherein a frame pivotally supports said beam at a part thereof distant from said lever, and said adjusting means including a means connected to said beam for turning the latter to contribute also to movement of said portion of said upper wire toward and away from said lower wire.

15. The combination of claim 14 and wherein said beam carries means displaced by turning of said beam with respect to said frame into and out of engagement with said portion of said lower wire for influencing the dewatering action at least during said twin-wire operation of said portions of said wires.

* * * * *